US006367485B1

(12) United States Patent
Dutton-Davis et al.

(10) Patent No.: US 6,367,485 B1
(45) Date of Patent: Apr. 9, 2002

(54) ACRYLIC FINGERNAIL REMOVAL STRIP

(76) Inventors: Audrey Shelby Dutton-Davis; Amanda Jane Dutton, both of 8423 Clayborne, Houston, TX (US) 77078

( * ) Notice: Subject to any disclaimer, the term of this patent is extended or adjusted under 35 U.S.C. 154(b) by 0 days.

(21) Appl. No.: 09/597,054

(22) Filed: Jun. 20, 2000

(51) Int. Cl.[7] ..... A45D 29/00
(52) U.S. Cl. ..... 132/200; 132/73
(58) Field of Search ..... 132/200, 73, 73.5, 132/74.5, 285, 317, 318, 320; 206/581, 823, 235, 570; 602/41, 54, 6, 46, 52, 57, 58; 161/146; 128/846; 218/156

(56) References Cited

U.S. PATENT DOCUMENTS 4,321,936 A * 3/1982 Chaconas ..... 132/75
4,466,452 A * 8/1984 Ferrari ..... 132/75
4,510,954 A * 4/1985 Miller ..... 132/75
4,619,253 A * 10/1986 Anhauser et al. ..... 218/156
4,644,966 A * 2/1987 Ferrari ..... 132/73
4,800,904 A * 1/1989 Kinseley et al. ..... 132/73.5
5,383,891 A * 1/1995 Walker ..... 606/196
5,388,597 A * 2/1995 Smith et al. ..... 132/73.5
5,538,500 A * 7/1996 Peterson ..... 602/48
5,609,166 A * 3/1997 Walker ..... 132/73
5,613,506 A * 3/1997 Kurokawa ..... 132/73
5,782,788 A * 7/1998 Widemire ..... 602/48
5,823,203 A * 10/1998 Carroll et al. ..... 132/200
5,954,679 A * 9/1999 Baranitsky ..... 602/41
6,016,915 A * 1/2000 Almond ..... 206/570

* cited by examiner

*Primary Examiner*—Todd E. Manahan
*Assistant Examiner*—David C. Comstock
(74) *Attorney, Agent, or Firm*—John D. Gugliotta

(57) ABSTRACT

An acrylic fingernail removal strip having a foil strip with adhesive on each end. An absorbent pad element is affixed to the center portion, allowing the user to apply acetone onto the absorbent pad and wrap the removal strip about the finger nail to be removed, thereby causing the nail to be soaked in solvent and not the entire hand.

3 Claims, 3 Drawing Sheets

"PRIOR ART"

ACRYLIC FINGERNAIL REMOVAL STRIP

BACKGROUND OF THE INVENTION

1. Field of the Invention

The present invention relates generally to artificial fingernail extensions and, more particularly, to an apparatus in kit form that aids in the removal of artificial acrylic nails.

2. Description of the Related Art

One of the luxuries enjoyed by many women that relates to beauty or salon type indulgences is the manicure. During these procedures the finger nails are cut, shaped, cleaned, painted and polished to provide for a beautiful appearance of the fingernails and surrounding area. For those women whose fingernails are not long enough or of the proper shape or texture, artificial nails made of an acrylic material remain the first option of choice after natural nails. While these artificial nails are every bit as beautiful when properly prepared and applied, they do have several drawbacks. One of these drawbacks is the removal process, in which the fingers are soaked in acetone for up to a half an hour to dissolve the adhesive used to hold the acrylic nail to the natural nail. This extended soaking time often leads to cuticle damage, nail damage, and skin irritation.

A search of the prior art did not disclose any patents that read directly on the claims of the instant invention. The following patents disclose a device for removing artificial fingernails:

U.S. Pat. No. 5,823,203 issued in the name of Carroll et al.;

U.S. Pat. No. 5,609,166 issued in the name of Walker; and

U.S. Pat. No. 5,388,597 issued in the name of Smith et al.

U.S. Pat. No. 5,613,506 issued in the name of Kurokawa discloses a device for removing a manicure coating.

U.S. Pat. No. 4,644,966 issued in the name of Ferrari discloses a fingernail treatment arrangement.

U.S. Pat. No. 4,510,954 issued in the name of Miller discloses a method and apparatus for automatically removing fingernail polish.

U.S. Pat. No. 4,466,452 issued in the name of Ferrari discloses a fingernail treatment arrangement.

U.S. Pat. No. 4,321,936 issued in the name of Chaconas, which discloses a nail polish remover, as well as in other related references, disclose element of the basic concept as the present invention. However, other elements in combination are different enough as to make the present combination unique and unanticipated in the art.

Consequently, there is a need for a means by which artificial nails can be removed in a quick and easy manner without the drawbacks normally associated with common removal procedures.

SUMMARY OF THE INVENTION

Therefore, it is an object of the invention to indicate a device of the type disclosed above which avoids the disadvantages inherent in the state of the art. In particular, the device is to allow removal of nails without soaking, and to allow the user to perform other tasks while eliminating long term damage associated with soaking of fingers in containers of acetone.

Briefly described according to the preferred embodiment of the present invention, an apparatus in kit form is provided that aids in the removal of artificial acrylic nails. A few drops of acetone are placed on the nail along with a few drops on a cotton pad. The pad is then placed on the nail where it is secured and encased with a strip of metal foil. The foil is wrapped around the nail and secured to itself, as well as the finger, with an adhesive strip. The foil also allows for heat retention which aids the acetone in the removal process. This process is repeated for the remaining fingers. In approximately 15 to 20 minutes the foil, the cotton ball as well as the artificial acrylic nail can be removed easily. During the 15 to 20 minute waiting time, the user can perform other tasks without being tethered to a container of acetone, as would be required by the conventional method of nail removal.

The use of the present invention allows for the quick, easy and efficient removal of artificial acrylic nails without the drawbacks normally associated with such products.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENTS

Figure 1:
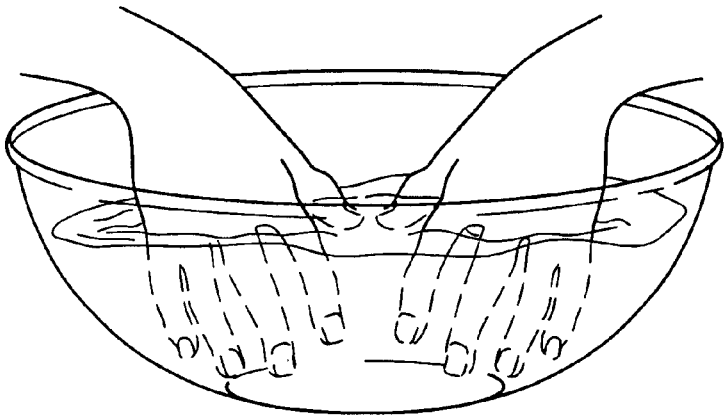
FIG. 1 is a perspective illustration depicting the PRIOR ART.

Referring now to FIG. 1, the current method of removing artificial fingernail extensions is depicted. As is common in the prior art, the user merely soaks the fingernail extensions in a container of solvent, commonly acetone. The acetone thereby penetrates under the acrylic nail to solvate the cement bonding the artificial nail to the individuals natural nail, causing the cement to fail and the artificial nail to be released.

Figure 2:
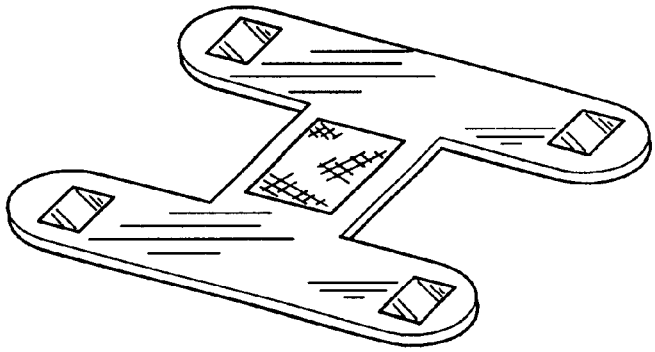
FIG. 2 is a top plan view of a self adhesive foil strip with embedded pad for use with the present invention.

The present invention incorporates the solvent action, utilizing a more directed application method to eliminate excess skin exposure to harsh solvents. To accomplish this, as shown in FIG. 2 an acrylic fingernail removal strip 10 is provided consisting primarily of a self adhesive foil strip with an embedded pad provided for use with the present invention. A foil strip 20 is formed of a linearly elongated strip having adhesive 22 applied to each outer strip end 24. Located at the center of the strip 20 is an absorbent pad element 26 affixed to the foil along the same side as the adhesive 22. It is felt that a standard cotton pad for use as the absorbent pad element 26 is sufficient, although other materials would certainly provide sufficient functionality.

Figure 3:
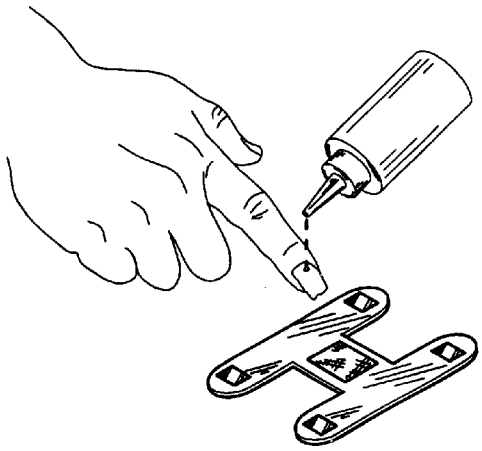
FIGS. 3–6 are perspective illustrations depicting the method and apparatus of the preferred embodiment of the present invention.
Figure 4:
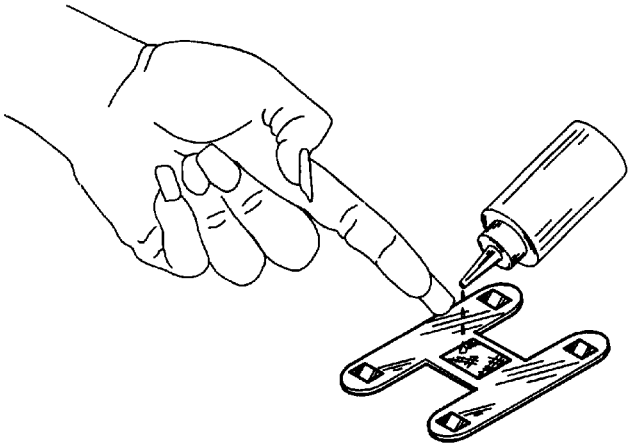
Figure 5:
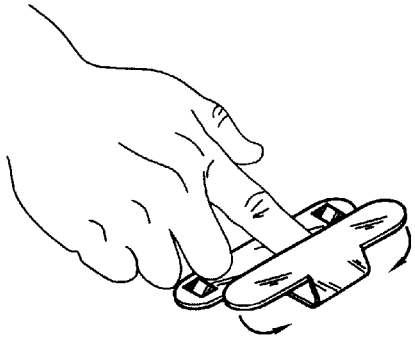
Figure 6:
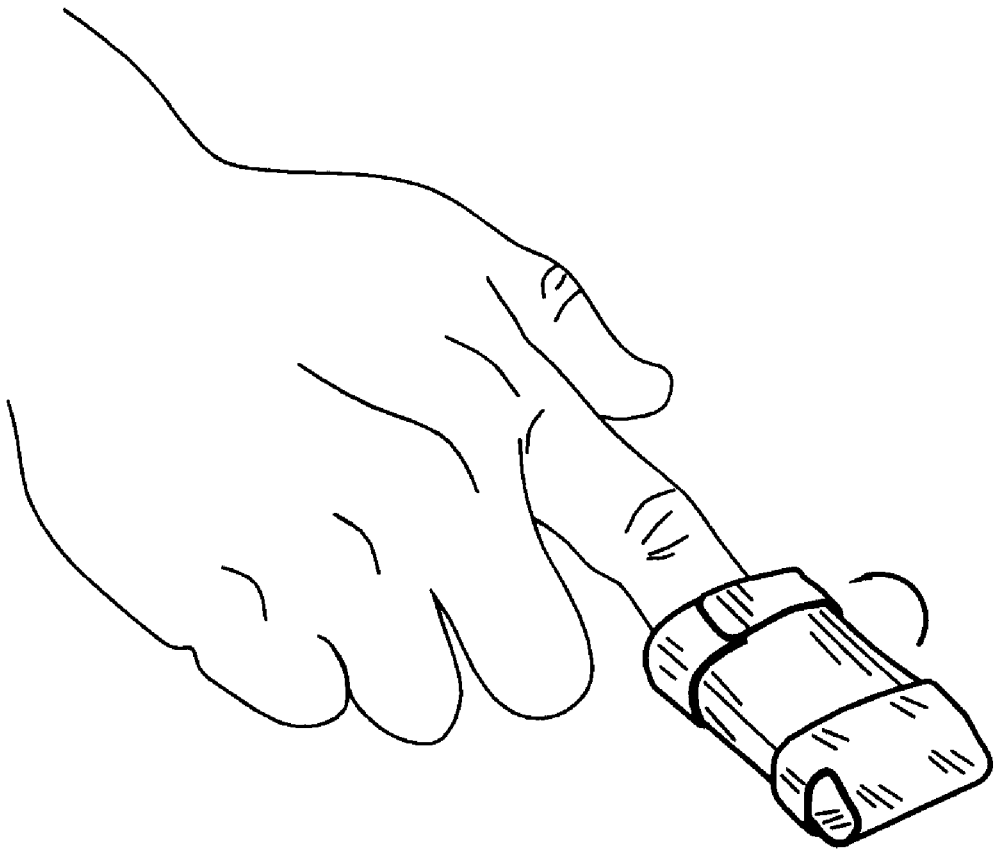

In use, as best described in FIGS. 3–5, the acrylic fingernail removal strip 10 is provided as part of a kit form that is used to aid in the removal of artificial acrylic nails. A few drops of acetone 40 are placed on the nail 42. Similarly, a few drops of acetone 40 are placed on the absorbent pad element 26. The pad 26 is then placed on the nail 42 where it is secured and encased by adhering each adhesive end 22 about the user's finger. The foil 20 is wrapped around the nail 42 and secured to itself, as well as the finger. In this manner, the foil also allows for heat retention which aids the acetone in the removal process.

This process is repeated for any and all fingers, as required or desired. In approximately 15 to 20 minutes the foil with the pad, as well as the artificial acrylic nail can be removed easily.

During the 15 to 20 minute waiting time, the user can perform other tasks without being required to continuously soak his or her fingers in a container of acetone, as would be required by the conventional method of nail removal.

As designed, a device embodying the teachings of the present invention is easily applied. The foregoing description is included to illustrate the operation of the preferred embodiment and is not meant to limit the scope of the invention. As one can envision, an individual skilled in the relevant art, in conjunction with the present teachings, would be capable of incorporating many minor modifications that are anticipated within this disclosure. Therefore, the scope of the invention is to be broadly limited only by the following claims.

What is claimed is:

1. A kit for use in the removal of artificial nail extensions, said kit comprising:

a plurality of foil strips, each said foil strip being linearly elongated, having an upper surface opposed to a lower surface and further having a first end and a second end respectively about a center portion, each said foil strip having adhesive applied to said lower surface at said first end and an absorbent pad element affixed to said center portion of said lower surface;

a solvent applicator, said solvent applicator for dispensing solvent and applying solvent to said absorbent pad element; and solvent, said solvent contained within said solvent applicator.

2. The kit of claim 1, wherein said solvent comprises acetone.

3. A method for removal of artificial nail extensions from a user's natural nails, said method comprising the steps:

A. Selecting an acrylic fingernail removal strip having adhesive applied to a lower surface and further having an absorbent pad element affixed to a center portion of said lower surface;

B. Applying acetone onto the nail to be removed;

C. Applying of acetone onto the absorbent pad element;

D. Securing and encasing said acrylic fingernail removal strip about the user's finger;

E. Waiting between 15 to 20 minutes; and

F. Removing the acrylic fingernail removal strip and artificial acrylic nail from the user's finger.

* * * * *